US005210541A

United States Patent [19]

Hall et al.

[11] Patent Number: 5,210,541

[45] Date of Patent: May 11, 1993

[54] MICROSTRIP PATCH ANTENNA ARRAYS

[75] Inventors: Peter Hall, Swindon; Stephen Vetterlein, Devon, both of England

[73] Assignee: Secretary of State for Defence in Her Britannic Majesty's Government The United Kingdom of Great Britain and Northern Ireland, London, England

[21] Appl. No.: 762,006

[22] PCT Filed: Jan. 31, 1990

[86] PCT No.: PCT/GB90/00141

§ 371 Date: Sep. 20, 1991

§ 102(e) Date: Sep. 20, 1991

[87] PCT Pub. No.: WO90/09042

PCT Pub. Date: Aug. 9, 1990

[30] Foreign Application Priority Data

Feb. 3, 1989 [GB] United Kingdom ..... 89024210

[51] Int. Cl.[5] ..... H01Q 1/380; H01Q 11/020; H01Q 3/300; H01Q 21/060

[52] U.S. Cl. ..... 343/700 MS; 343/731; 343/739

[58] Field of Search ..... 343/700 MS, 731, 739, 343/770, 771, 732–738

[56] References Cited

U.S. PATENT DOCUMENTS

| | | | |
|---|---|---|---|
| 3,775,771 | 11/1973 | Scherer | 343/770 |
| 4,173,019 | 10/1979 | Williams | 343/700 MS |
| 4,347,516 | 8/1982 | Shrekenhamer | 343/700 MS |
| 4,450,449 | 5/1984 | Jewitt | 343/700 MS |
| 4,780,723 | 10/1988 | Mead | 343/700 MS |
| 4,899,163 | 2/1990 | Daniel et al. | 343/700 MS |
| 4,912,481 | 3/1990 | Mace et al. | 343/700 MS |
| 4,937,585 | 6/1990 | Shoemaker | 343/700 MS |

FOREIGN PATENT DOCUMENTS

| | | | |
|---|---|---|---|
| 2187043A | 6/1987 | United Kingdom | 343/700 MS |

OTHER PUBLICATIONS

Electronics Letters, vol. 25, No. 17, 17 Aug. 1989, (Stevenage, Herts., GB), S. J. Vetterlein et al., "Novel Multiple Beam Microstrip Patch Array with Integrated Beamformer", pp. 1149–1150.

International Search Report for PCT/GB90/00141.

*Primary Examiner*—Rolf Hille

*Assistant Examiner*—Peter Toby Brown

*Attorney, Agent, or Firm*—Nixon & Vanderhye

[57] ABSTRACT

A patch antenna array having multiple beam-forming capability is formed as a feed network (15) on a lower microstrip substrate with patches (13) overlaying these on an upper substrate. The patch array consists of a number of linear series-connected patch arrays (13*a*, 13*b*, 13*c*) each array being resonant and may have open circuits at each end. A travelling wave arrangement of feed lines (15*a*, 15*b*, 15*c*) is provided and in one embodiment the total number of beams which may be generated is twice the number of feed lines. The invention is useful in small satellite communication earth terminals and is suitable for operation in the region of 10 GHz.

10 Claims, 7 Drawing Sheets

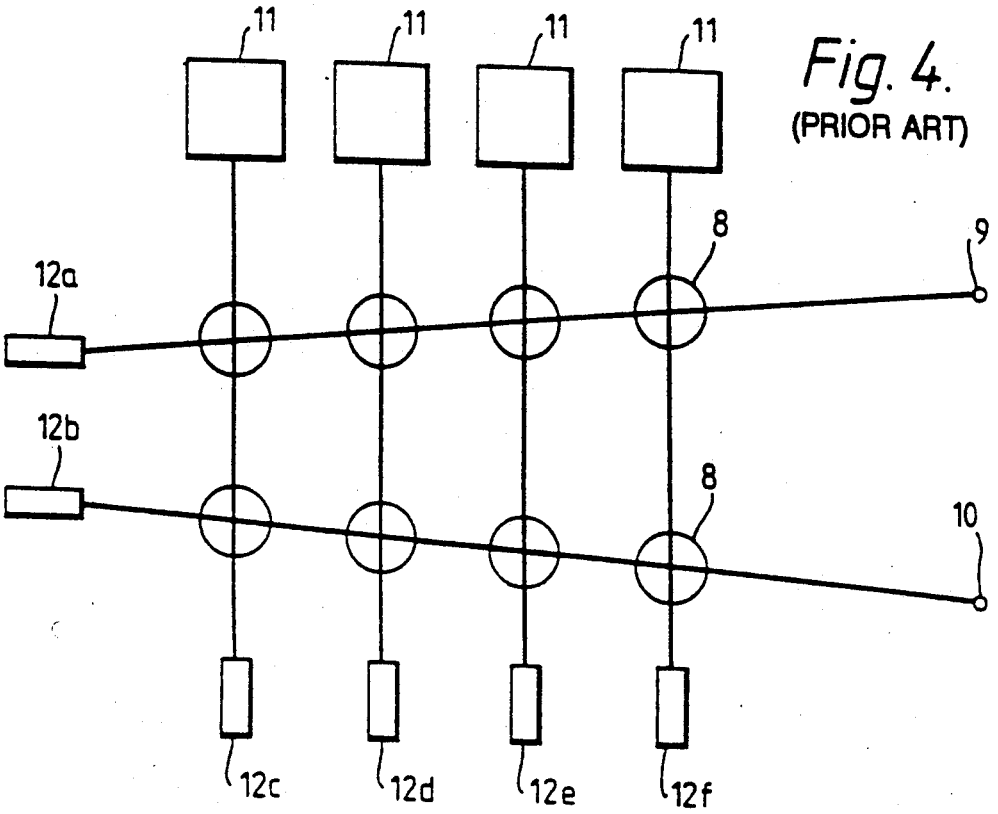
Fig. 4.
(PRIOR ART)
Fig. 5.
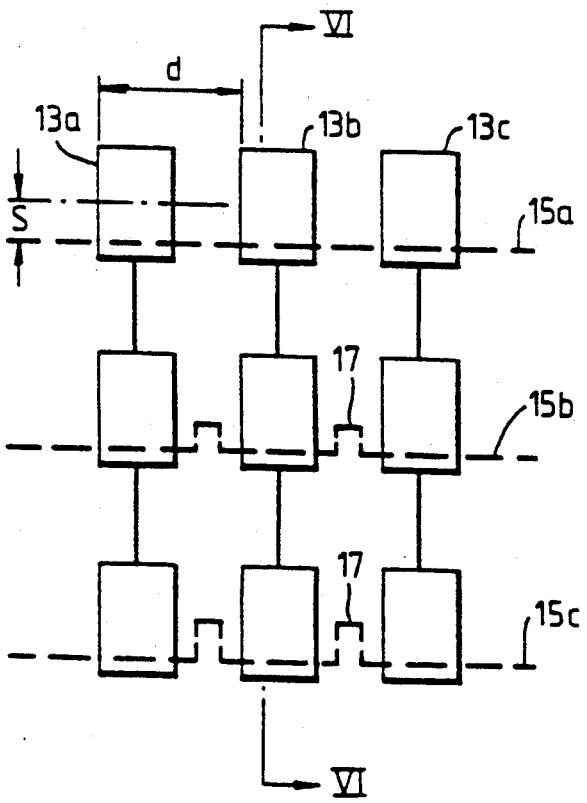

MICROSTRIP PATCH ANTENNA ARRAYS

BACKGROUND OF THE INVENTION

1. Field of the Invention

This invention relates to microstrip patch antenna arrays having applications in the fields of communications and radar. Microstrip patch antennas are particularly useful for spacecraft and aircraft applications on account of their light weight and flat profile.

2. Discussion of Prior Art

A section of a conventional microstripline is shown in FIG. 1. It comprises a conducting ground plane 1, a dielectric spacer 2 and a conductor 3. For a straight, infinitely long strip, virtually no radiation will occur as long as the separation between the conductor 3 and ground plane 1 is small compared with the wavelength of the propagating wave. However, in the presence of a discontinuity, the field in the gap between the conductor 3 and the ground plane 1 becomes unbalanced and the gap radiates.

Any patch of microstrip such as the patch 4 shown in FIG. 2 has a radiating aperture around its rim. If fields and currents are excited by a stripline feed 5, for example, the patch 4 will radiate. The shape of the patch and method and location of its feed determine the field distribution and therefore its radiation characteristics. The most commonly used patches are rectangular, square or circular, such patches producing a fairly broad, single beam of radiation in a direction normal to their surfaces and in the case of rectangular patches, producing a controllable polarisation effect.

Microstrip patches are most commonly used in planar arrays for applications where a narrow beam pattern is required. A plan-view of a typical planar microstrip patch array layout is shown in FIG. 3. It comprises a plurality of rectangular conducting patches 6 fed via a microstrip feedline 7 which is printed onto the same substrate as the patches. The array shown in FIG. 3 has a narrow single beam pattern.

Other discontinuities such as apertures in an otherwise uniform conducting layer will also cause the generation of radiation in the same way, and the term "patch" as used hereinafter shall include such apertures.

It is an object of the present invention to provide a microstrip patch array having a multiple beam capability to facilitate simultaneous or switched coverage of a wide field of view.

Hitherto, multiple beam arrays have been formed by feeding appropriately grouped radiating elements (microstrip patches, for example) via a "beamforming" circuit. A well-known example of a beamforming circuit is the so-called Blass matrix which is shown schematically in FIG. 4. It comprises a grid of transmission lines and directional couplers 8 which couple input power applied to beam ports 9 and 10 to radiating patches 11 (12*a* to 12*f* are matched loads). Patch spacing and interconnecting line lengths determine beam direction. In the arrangement of FIG. 4, the number of beams is equal to the number of beam ports.

SUMMARY OF THE INVENTION

Although the beamforming circuitry is located in close proximity to the patch array, it is a separate entity and can occupy a significant volume. For large arrays with many beams, such matrices are bulky. This is a disadvantage when the antenna is required to be operated in a restricted space. The present invention provides a much more compact arrangement in which the antenna and beam forming functions are integrated into a single structure.

This invention consists of a multiple beam microstrip patch antenna array including N substantially parallel columns and n substantially parallel rows of radiating elements (13) and n feed lines (15), each feed line being coupled to a corresponding one of the n rows of elements in which the n elements within each of the N columns are electrically connected to form linear arrays which are terminated so that a voltage standing wave is produced along the arrays when an appropriate excitation signal is applied to at least one of the feed lines, characterised in that the effective lengths of feed line between adjacent elements along one feed line differ from the effective lengths of feed line between adjacent elements along at least one other feed line.

The array can be fabricated using microcircuit techniques. In one embodiment the coupling between the feed lines and their associated elements is electromagnetic, the elements overlaying the feed line network and being separated therefrom by a dielectric layer. In an alternative embodiment the feed line network and elements are formed on the same substrate and the feed lines are directly connected to the appropriate elements.

BRIEF DESCRIPTION OF THE DRAWINGS

By way of example, a number of embodiments of the invention will now be described with reference

FIG. 4 is a schematic plan view of a Blass matrix;

FIG. 5 is a schematic plan view of a first embodiment of a multiple beam microstrip patch antenna array in accordance with the invention.

DETAILED DESCRIPTION OF PREFERRED EMBODIMENTS

Figure 1:
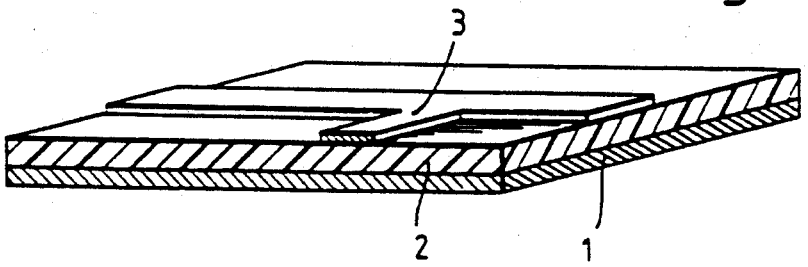
Fig. 1. (PRIOR ART)
FIG. 1 is a schematic perspective view showing a conducting element formed on a dielectric material.
Figure 2:
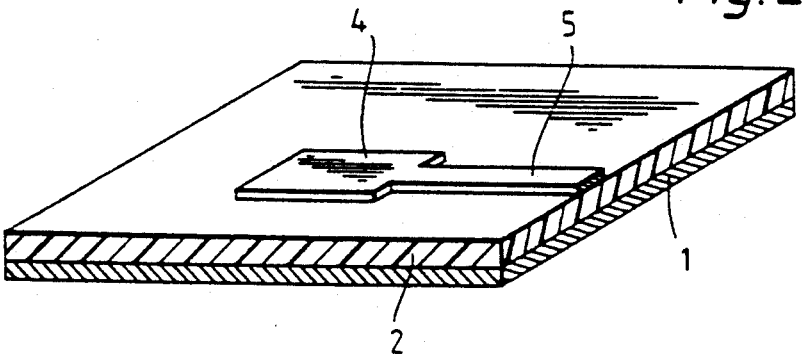
Fig. 2. (PRIOR ART)
FIG. 2 is a similar view of a single radiating element.
Figure 3:
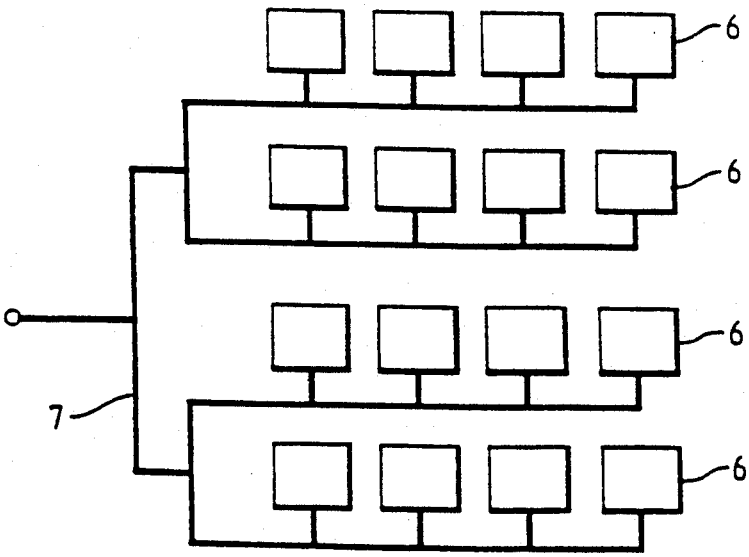
Fig. 3. (PRIOR ART)
FIG. 3 is a schematic plan view of a simple array of interconnected radiating elements.
Figure 6:
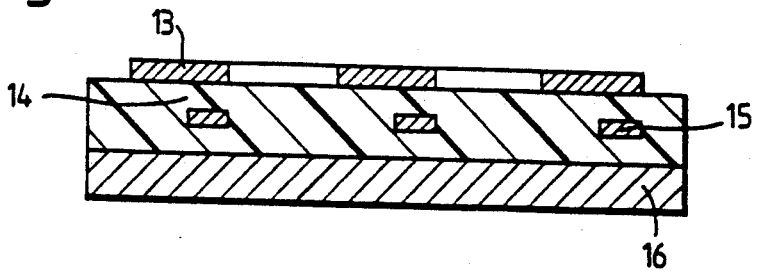
FIG. 6 is a sectional view along the line V1—V1 of FIG. 5.

With reference to FIG. 6, a microstrip patch antenna array comprises a network of microstrip patches 13 separated by a dielectric material 14 from a network of feed lines 15 which is in turn separated by the dielectric material 14 from a ground plane 16.

As shown in FIG. 5, the microstrip patch network comprises three linear series-connected patch arrays 13*a*, 13*b* and 13*c*, there being three patches in each linear array. The network of feed lines which runs underneath the patch network is represented by the dotted lines 15*a*, 15*b* and 15*c*. The feed lines are offset from the centre of each patch by a distance 'S' and the lengths of each feed line are different owing to the presence of meanders 17 incorporated in 15*b* and 15*c*. Each linear patch array is separated from its nearest neighbour by a distance d and each array has an open circuit at each of its ends.

Figure 7:
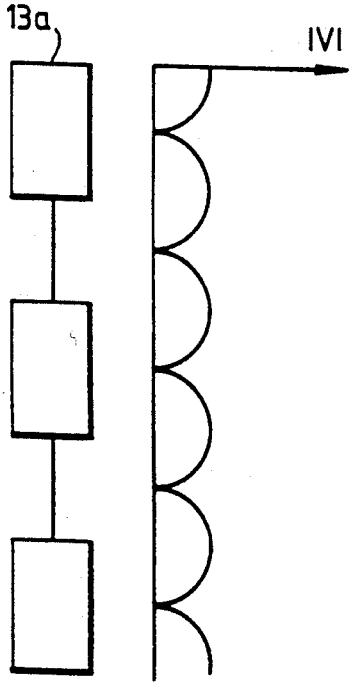
FIG. 7 illustrates a voltage standing wave pattern along a linear patch array.

In operation, an RF excitation signal is applied to each of the feed lines 15*a*, 15*b* and 15*c*. The separation between adjacent patches in each linear array is chosen so that the array behaves as a resonant element for a particular excitation frequency. Thus a voltage standing wave pattern is set up along each linear array as shown in FIG. 7. As the standing wave is periodic along the linear array, it is possible to excite it at any of the voltage peaks. Thus any feed line running under the patches can excite a standing wave on each of the linear arrays which results in a narrow pencil beam of radiation.

Figure 8A:
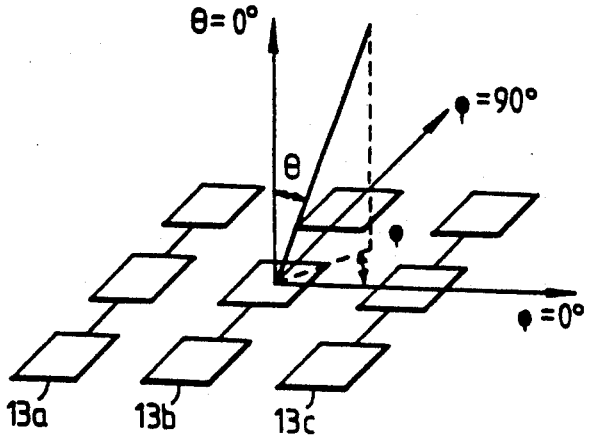
FIGS. 8*a* and 8*b* illustrate radiated beam directions with reference to the patch array of FIG. 5, FIG. 9 and FIG. 10 are plots of radiation patterns peculiar to the embodiment of FIG. 5.
Figure 8B:
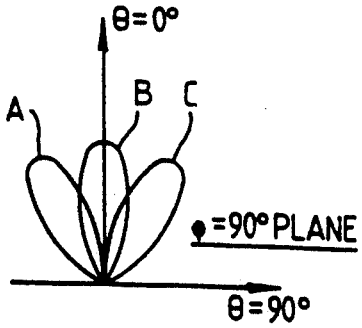

In an idealised case, the beam direction will always be in a plane perpendicular to the line of each linear array. FIG. 8 illustrates this. Each linear array lies along the $\phi=90°$ direction and in the $\phi=90°$ plane the beam is always at $\theta=0°$. In the other plane, that is for $\phi=0°$, the beam direction is dependent on the well known feeding arrangement for travelling wave arrays and the beam direction $\theta$ is given by $$\sin\theta = \left\{ \frac{d'}{d} + \left( p + \frac{\delta}{2} \right) \frac{\lambda_m}{d} \right\} \sqrt{\epsilon_e} \qquad (1)$$

where d and d' are the linear array spacing and length of feed line connecting them respectively, $\lambda_m$ and $\epsilon_3$ are the feed line wavelength and effective dielectric constant respectively, p is an integer and $\delta=0$ or 1 for an unswitched or switched array respectively (see below). d' and hence the beam direction can be controlled by varying the line lengths in the feed line by means of the meanders 17 shown in FIG. 5. It is thus apparent that this particular array has three possible beam directions (A, B and C in FIG. 8*b*) for each feed line, although in many practical cases, only $p=-1$ will provide $\sin\theta<1$. In addition if the feed line is excited from both ends, beams at $(180°-\theta)$ will also be generated, giving a total, in the general case, of 2n beams, where n is the number of feed lines.

The radiated beams are linearly polarised along the rectangles, i.e., in the $\phi=90°$ direction of FIG. 8. To supress cross-polarisation, rectangular patches are used whose dimension in the $\phi=0°$ direction is significantly less than half the separation between adjacent patches of the same linear array.

Isolation between feed lines is controlled by the coupling at the junction between each feed line and each linear array. Inherently good isolation is likely to be produced by the partial cancellation of each of the small signals coupled into neighbouring feed lines due to the different lengths of each line. The coupling is controlled by the separation in height of the feed line network and the patch network and by the offsets 'S' of the feed line from the centre of the patch and by the width of the patch. This coupling is determined by the required amplitude distribution across the array and will be lower for longer arrays.

Figure 9:
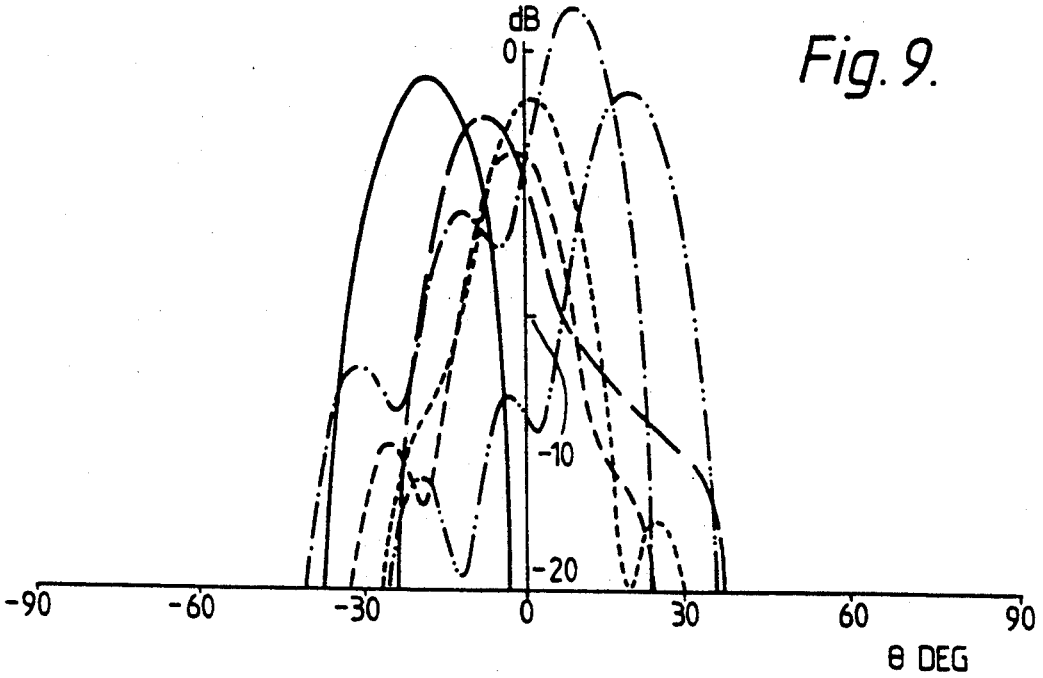
Figure 10:
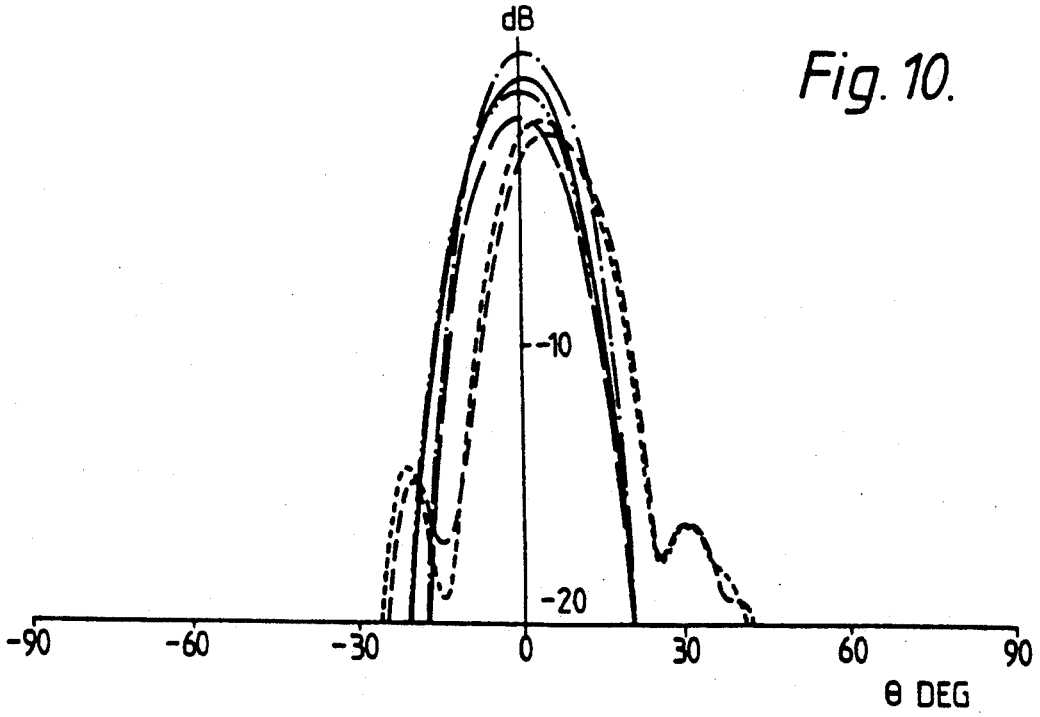

FIGS. 9 and 10 show the measured radiation patterns at 10.3 GHz in the $\phi=0°$ and $\phi=90°$ planes respectively of a $5\times5$ element antenna array of the form of FIG. 5 using two PTFE substrates of thickness 0.79 mm and $\epsilon_r=2.32$. In this example, three feed lines are excited from both ends giving a total of six beams. Approximately equal spacing between beams occurs in each set of three beams as would be expected.

Figure 11:
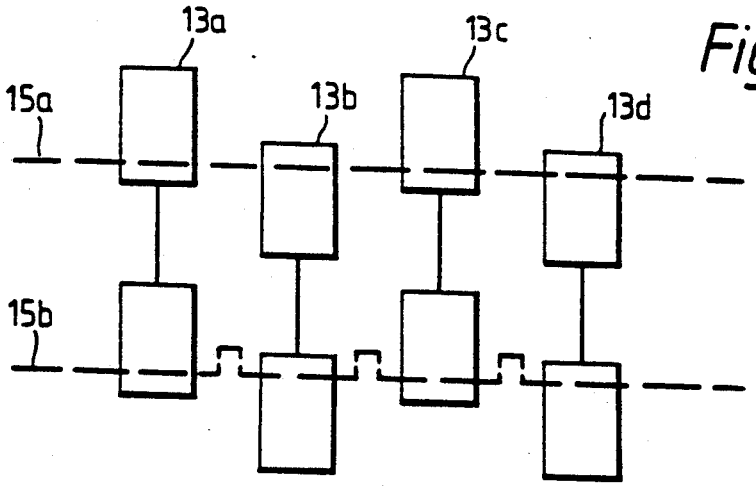
FIG. 11 is a schematic plan view of a second embodiment of the invention, having alternating offsets between feedlines and patches.

Referring again to Eqn (1) indicates that with $\delta=0$, corresponding to the arrangement of FIG. 5, beams with large $\theta$ will be accompanied by unacceptably large grating lobes. This operation is well known and is associated with forward firing beams in travelling wave arrays. Use of $\delta=1$ in Eqn (1) results in backward firing beams and suppresses the grating lobes. This can be implemented using the configurations shown in FIG. 11, by alternately phased excitation of each linear array, 13*a*, 13*b*, 13*c* and 13*d*. Arranging the network of microstrip patches to overlay the feed line network 15*a*, 15*b* at alternate patch ends results in the required opposite phase excitation. The patch network and feed line network are separated by a dielectric layer as in the case of the embodiment of FIG. 5.

Figure 12:
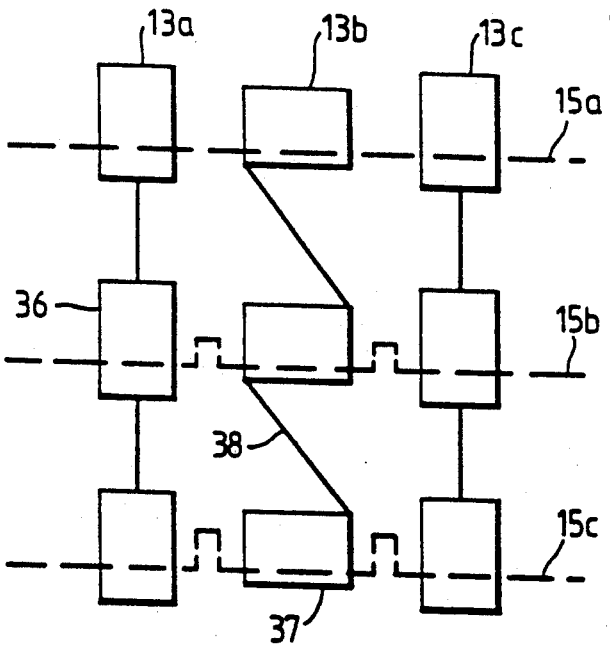
FIG. 12 is a schematic plan view of a third embodiment of the invention, in which alternate rows of rectangular patches are rotated through 90°.

Circulary polarised beams can be produced using the embodiment of FIG. 12 which is similar in construction to the embodiment of FIG. 5 in that feed lines 15*a*, 15*b* and 15*c* are overlaid by linear patch arrays 13*a*, 13*b* and 13*c*, in which the rectangular patches in alternate linear arrays (see 13*b* in FIG. 12) are rotated through 90° and connected to one another within each linear array by diagonal interconnections joining alternate ends of each patch. The length of each of the feed lines 15*a*, 15*b* between adjacent patches is arranged so that the phase of the excitation signal at one patch differs from the phase at its adjacent patch by 90°. Feeding the excitation signal in from the opposite end of the feed line results in beams with the opposite hand of polarisation.

Figure 13:
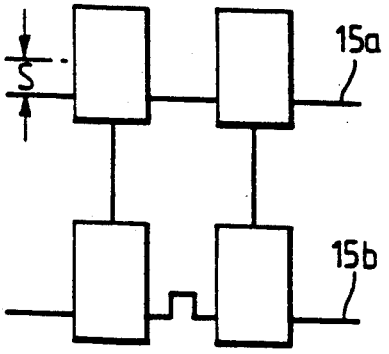
FIG. 13 is a schematic plan view of a fourth embodiment of the invention, implemented on a single dielectric layer.

The invention can be implemented on a single dielectric layer as shown in the embodiment of FIG. 13. Here the feed lines 15*a*, 15*b* are directly connected to the patch sides with the dimension S controlling the coupling level. This results in simpler construction although unwanted radiation from the feed lines is greater than for the multilayer construction of the embodiments illustrated in FIGS. 5, 11 and 12.

Figure 14:
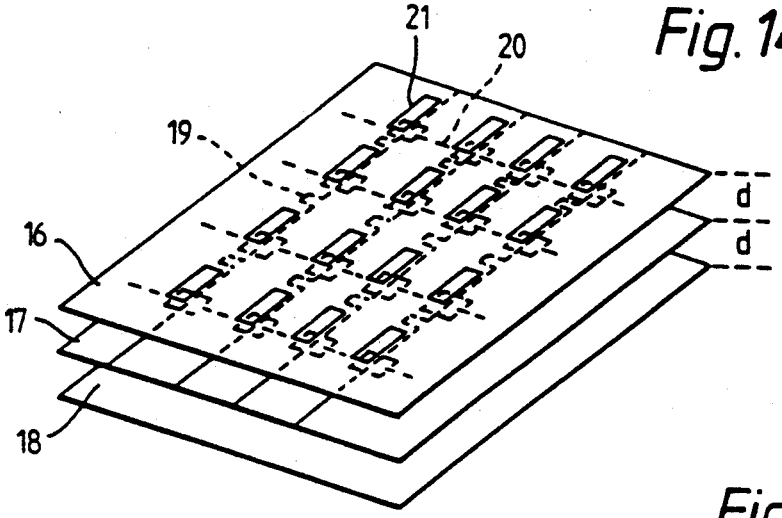
FIG. 14 is a schematic perspective view of a further embodiment of the invention operating as a balanced stripline device.
Figure 15:
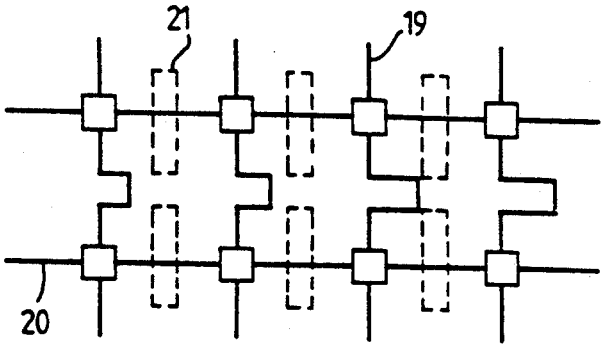
FIG. 15 is a more detailed schematic plan view of part of the embodiment shown in FIG. 14.

Direct coupling of the feed and array lines can be usefully employed in a balanced stripline construction such as that illustrated in FIGS. 14 and 15. This construction comprises three superimposed layers 16, 17 and 18 of etched copper on substrate maintaining a separation d between the conducting layers. The middle layer 17 consists of a network in which meandering feedlines 19 interconnect with array lines 20. The top and bottom layers 16 and 18 comprise identical arrays of rectangular slots 21 formed in the copper layer which, when assembled, are located symmetrically on either side of the middle layer, over-and under-lying the array lines 20.

Radiation initiated from the feed lines 19 is through the slots 21 in the top and bottom layers by coupling from the array lines 20. This balanced structure suppresses the generation of higher order modes, whilst radiation in either direction, if unwanted, can be suppressed by placing a planar metal sheet a quarter wavelength in front of the respective upper or lower array of slots 21.

Figure 16:
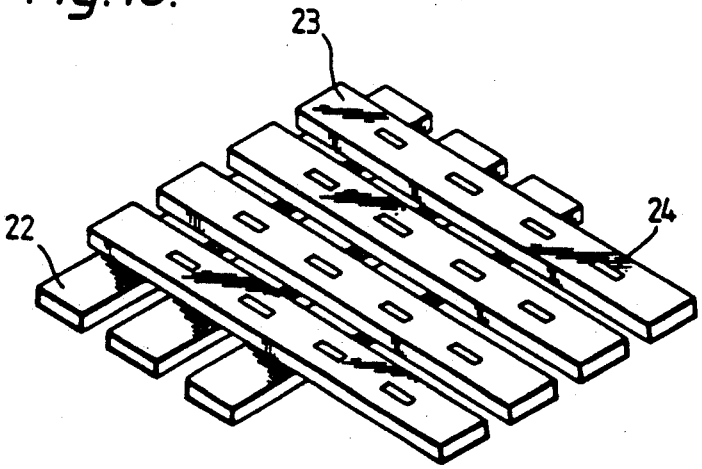
FIG. 16 is a schematic perspective view of an embodiment of the invention using waveguides.

As an alternative to the use of conducting materials for the feed and/or array lines, waveguides may be used as illustrated in FIG. 16. In this example, both the feed lines 22 and the transverse resonant arrays 23 are made of waveguide material, coupled together by small holes in the common wall at each intersection. The arrays themselves are formed by conventional waveguide slots 24. The feed lines are made to have different effective lengths by one of the numerous ways of providing phase shifts in a waveguide, such as an iris, a screw extending in from the waveguide wall, or a section of dielectric.

Figure 17:
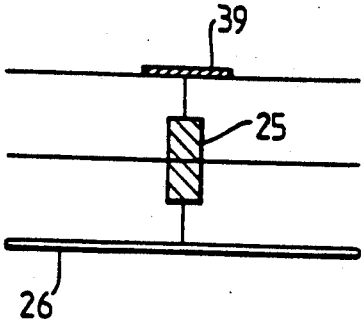
FIGS. 17 and 18 are a schematic plan and section of a suitable termination for the ends of the array lines.
Figure 18:
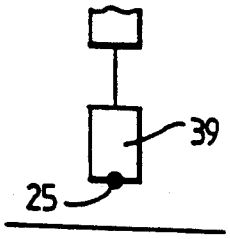

The bandwidth of any of these devices can be increased, at the expense of some changes in the beam shape with frequency in the $\phi=90°$ plane (See FIG. 8*a*), by end-loading of the arrays. In the embodiment shown in FIGS. 17 and 18, a terminating impedance 25 is arranged to interconnect the ground plane 26 and the remote edge of the end patch 39 of each array. Alternatively, a patch of lossy material may be placed on the feedline substrate in a position underlying portions of the end patch of each array.

Figure 19:
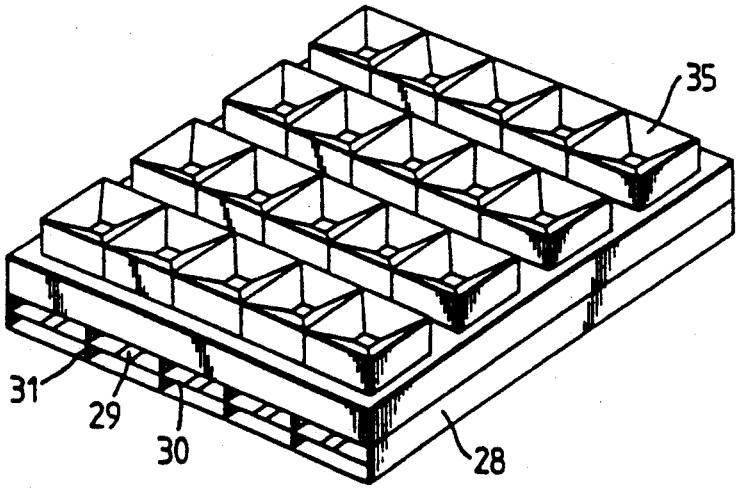
FIG. 19 is a schematic perspective view of an embodiment of the invention in which the feedlines comprise suspended striplines and are coupled to resonant cavities feeding from radiators.
Figure 20:
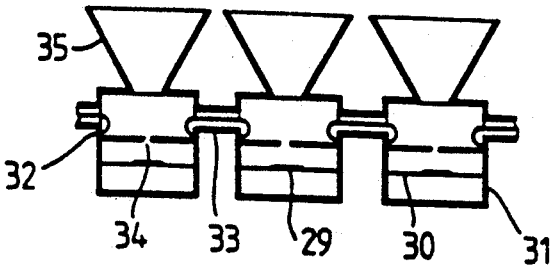
FIG. 20 is a more detailed sectional view of part of the embodiment shown in FIG. 19.

An embodiment incorporating further alternative features is shown in FIGS. 19 and 20. The feedlines 28 comprise suspended stripline feeds in each of which a conducting stripline element 29 is located on a thin substrate film 30 centrally within a waveguide box 31 (Alternatively all the striplines could be configured on a single substrate within an extended waveguide). The antenna arrays comprise series of square or rectangular cavities 32 (see FIG. 20) interconnected by coaxial lines 33 and coupled to the feedlines by small holes 34 in the roof of the waveguide. The cavities either radiate directly through small holes or, as shown in the drawing, they can feed short horn elements 35. The effective lengths of the stripline elements 29 differ from one another, as before.

The person skilled in the art will readily conceive further variants within the scope of this invention.

We claim:

1. A multiple beam microstrip patch antenna array comprising:

a plurality of microstrip radiating elements, said radiating elements arranged into N substantially parallel columns and n substantially parallel rows elements (13), each of said N columns having n elements; and n feed lines, each of said feed lines coupled to a corresponding one of the n parallel rows of elements;

means for electrically connecting all of said n elements in a respective N column in series forming N linear arrays and said linear arrays are terminated so that a voltage standing wave is produced along each linear array when an appropriate excitation signal is applied to at least one of the n feed lines, wherein each element in a row is separated from an adjacent element by a length of feed line and lengths of feed line between adjacent elements along one row differ from the lengths of feed line between adjacent elements along at least one other row.

2. An antenna array as claimed in claim 1 in which the radiating elements (13) overlay the feed lines and are separated therefrom by a dielectric material (14).

3. An antenna array as claimed in claim 1 in which each column comprises radiating elements formed as metallic, rectangular patches on a dielectric substrate.

4. An antenna array as claimed in claim 1, in which each feed line (15) is offset in the same direction from the center of each element (13) to which it is coupled.

5. An antenna array as claimed in claim 1 in which each feed line (15) is offset from the center of each element (13) to which it is coupled in alternating directions.

6. An antenna array as claimed in claim 1 in which the elements (13) are rectangular and are alternately positioned transverse to (36) and in line with (37) the feed lines (15) in successive columns, elements which are in-line with feed lines are electrically connected to one another by said means for electrically connecting by diagonal, with respect to said rows and columns, interconnections (38) joining alternate ends of each of said elements which are in-line.

7. An antenna array as claimed in claim 1 in which each linear array (13) is terminated by an impedance (25) connected between its end elements (39) and a ground plane (26).

8. A multiple beam microstrip patch antenna array comprising:

a plurality of microstrip radiating elements in which each of said elements is rectangular, said radiating elements arranged into N substantially parallel columns and n substantially parallel rows, each of said N columns having n elements;

means for electrically connecting all of said n elements in a respective N column in series forming N linear arrays; and n feed lines, each of said feed lines coupled to a corresponding one of the n parallel rows of elements, wherein N elements in respective n feed lines are alternately positioned transverse to and in line with the feed lines in successive columns, elements which are in-line with feed lines are electrically connected to one another by said means for electrically connecting by diagonal, with respect to said rows and columns, interconnections joining alternate ends of each of said elements which are in-line; and means for terminating each of said linear arrays so that a voltage standing wave is produced along each linear array when an appropriate excitation signal is applied to at least one of the n feed lines, wherein each element in a row is separated from an adjacent element by a length of feed line and lengths of feed line between adjacent elements along one row differ from the lengths of feed line between adjacent elements along at least one other row.

9. An antenna array as claimed in claim 8 in which the radiating elements overlay the feed lines and are separated therefrom by a dielectric material.

10. An antenna array as claimed in claim 8 in which each column comprises radiating elements formed as metallic, rectangular patches on a dielectric substrate.

* * * * *